US008684276B2

(12) United States Patent
Vandrak

(10) Patent No.: US 8,684,276 B2
(45) Date of Patent: Apr. 1, 2014

(54) PORTABLE CATALYTIC HEATER

(75) Inventor: Brian S. Vandrak, Highland Heights, OH (US)

(73) Assignee: Enerco Group, Inc., Cleveland, OH (US)

( * ) Notice: Subject to any disclaimer, the term of this patent is extended or adjusted under 35 U.S.C. 154(b) by 1186 days.

(21) Appl. No.: 12/544,466

(22) Filed: Aug. 20, 2009

(65) Prior Publication Data

US 2011/0042472 A1 Feb. 24, 2011

(51) Int. Cl.

| | |
|---|---|
| ***F23D 14/08*** | (2006.01) |
| *F23C 13/02* | (2006.01) |
| *F23D 5/16* | (2006.01) |
| *F23N 5/24* | (2006.01) |

(52) U.S. Cl.

USPC ..... 237/2 R; 237/2 A; 126/116 A; 422/110; 34/96

(58) Field of Classification Search

CPC ..... F23C 13/02; F23C 13/00; F23D 5/126; F23D 14/725; F23D 14/18; F23N 5/242; F23N 5/245; F23N 5/247; F23N 5/10; F23N 5/24

USPC ..... 237/2 A; 34/96; 126/116 A; 422/110

See application file for complete search history.

(56) References Cited

U.S. PATENT DOCUMENTS

| | | | | |
|---|---|---|---|---|
| 1,639,780 | A | 8/1927 | Mulholland | |
| 2,997,869 | A * | 8/1961 | Weiss | 431/147 |
| 3,139,879 | A | 7/1964 | Bauer et al. | |
| 3,240,256 | A * | 3/1966 | Binkley et al. | 431/241 |
| 3,590,806 | A | 7/1971 | Lock | |
| 3,814,573 | A | 6/1974 | Karlovetz | |
| D243,694 | S | 3/1977 | Faulkner | |
| 4,068,651 | A * | 1/1978 | Rappaport | 126/208 |
| 4,201,544 | A | 5/1980 | Briggs et al. | |
| 4,307,701 | A | 12/1981 | Balon et al. | |
| 4,340,362 | A | 7/1982 | Chalupsky et al. | |
| 4,348,172 | A | 9/1982 | Miller | |

(Continued)

FOREIGN PATENT DOCUMENTS

| | | | | |
|---|---|---|---|---|
| GB | 253043 | | 6/1926 | |
| JP | S54-116747 | | 9/1979 | |
| JP | 01179862 | A * | 7/1989 | F24H 3/04 |
| JP | 02050031 | A * | 2/1990 | F24D 19/10 |

OTHER PUBLICATIONS

O'Meara Camping Centers (web page), Cookers & Heaters, "Alvima Carasol 3b Heater", data sheets pp. 1-7, Jun. 26, 2002.

(Continued)

*Primary Examiner* — Kang Hu
*Assistant Examiner* — Daniel E Namay
(74) *Attorney, Agent, or Firm* — Brouse McDowell; Michael G. Craig

(57) ABSTRACT

Provided is a portable heating device comprising a combustion-powered heater, a regulator, and an oxygen depletion sensor. The combustion-powered heater may be supplied by an associated fuel source and may comprise a combustion region comprising a catalytic surface. The regulator may be adapted for fluid communication with the associated fuel source. The oxygen depletion sensor may comprise a burner and a temperature detector. The burner may be in fluid communication with the regulator and may be adapted to combust fuel form the regulator with air to produce a flame. The temperature detector may be adapted to detect the temperature of the flame and may be adapted to selectively render the combustion-powered heater non-functional.

19 Claims, 2 Drawing Sheets

(56) References Cited

U.S. PATENT DOCUMENTS

| | | | | | |
|---|---|---|---|---|---|
| 4,357,929 | A | * | 11/1982 | Johnson | 126/96 |
| 4,640,680 | A | | 2/1987 | Schilling | |
| 4,782,814 | A | | 11/1988 | Cherryholmes | |
| 4,843,313 | A | | 6/1989 | Walton | |
| 4,848,313 | A | | 7/1989 | Velie | |
| 5,090,899 | A | | 2/1992 | Kee | |
| 5,094,611 | A | * | 3/1992 | Suppiah et al. | 431/268 |
| 5,174,751 | A | | 12/1992 | Chapman et al. | |
| 5,215,456 | A | * | 6/1993 | Fujiwara | 431/7 |
| 5,239,979 | A | | 8/1993 | Maurice et al. | |
| 5,320,518 | A | * | 6/1994 | Stilger et al. | 431/7 |
| 5,368,475 | A | * | 11/1994 | Suppiah et al. | 431/268 |
| 5,394,862 | A | * | 3/1995 | Firatli et al. | 126/409 |
| 5,470,018 | A | | 11/1995 | Smith | |
| 5,546,925 | A | | 8/1996 | Knight et al. | |
| 5,628,303 | A | | 5/1997 | Ahmady et al. | |
| 5,645,043 | A | | 7/1997 | Long et al. | |
| D391,345 | S | | 2/1998 | Mandir et al. | |
| 5,807,098 | A | | 9/1998 | Deng | |
| 5,838,243 | A | | 11/1998 | Gallo | |
| 5,848,585 | A | | 12/1998 | Long et al. | |
| 5,865,618 | A | | 2/1999 | Hiebert | |
| 5,941,699 | A | | 8/1999 | Abele | |
| 5,948,377 | A | * | 9/1999 | Sung | 423/213.5 |
| 5,981,427 | A | * | 11/1999 | Sung et al. | 502/325 |
| 5,984,663 | A | | 11/1999 | Joyce | |
| 6,099,806 | A | * | 8/2000 | Cortellucci et al. | 422/126 |
| 6,162,046 | A | * | 12/2000 | Young et al. | 431/11 |
| D445,889 | S | | 7/2001 | Resmo et al. | |
| D447,796 | S | | 9/2001 | Resmo et al. | |
| 6,340,298 | B1 | * | 1/2002 | Vandrak et al. | 432/222 |
| 6,446,623 | B1 | | 9/2002 | Resmo et al. | |
| 6,526,964 | B1 | * | 3/2003 | Potter et al. | 126/110 C |
| 6,575,154 | B1 | | 6/2003 | Freeman et al. | |
| 6,585,509 | B2 | * | 7/2003 | Young et al. | 431/11 |
| 6,592,361 | B2 | * | 7/2003 | Adiga et al. | 431/4 |
| 6,619,281 | B2 | | 9/2003 | Resmo et al. | |
| 6,648,635 | B2 | | 11/2003 | Vandrak et al. | |
| 6,742,814 | B2 | | 6/2004 | Resmo et al. | |
| 6,792,937 | B2 | | 9/2004 | Resmo et al. | |
| 6,843,244 | B2 | | 1/2005 | McCalley et al. | |
| 6,921,738 | B2 | * | 7/2005 | Hwang et al. | 502/240 |
| 7,837,930 | B2 | * | 11/2010 | Grodsky | 422/5 |
| 7,988,984 | B2 | * | 8/2011 | Hockaday | 424/403 |
| 8,434,469 | B2 | * | 5/2013 | Vandrak | 126/92 B |
| 2002/0106597 | A1 | * | 8/2002 | Grando et al. | 431/24 |
| 2004/0170936 | A1 | * | 9/2004 | Weclas et al. | 431/7 |
| 2005/0196719 | A1 | * | 9/2005 | Mills et al. | 431/344 |
| 2005/0210737 | A1 | * | 9/2005 | Durand et al. | 43/139 |
| 2006/0070255 | A1 | * | 4/2006 | Kokuo et al. | 34/96 |
| 2007/0042301 | A1 | * | 2/2007 | Carroni et al. | 431/7 |
| 2007/0099136 | A1 | * | 5/2007 | Cook | 431/77 |
| 2007/0104625 | A1 | * | 5/2007 | Su | 422/189 |
| 2007/0186872 | A1 | * | 8/2007 | Shellenberger et al. | 122/4 D |
| 2008/0020336 | A1 | * | 1/2008 | Kaeding et al. | 431/75 |
| 2008/0092433 | A1 | * | 4/2008 | Durand et al. | 43/107 |
| 2008/0092513 | A1 | * | 4/2008 | Carroni et al. | 60/39.23 |
| 2008/0096062 | A1 | * | 4/2008 | Lee et al. | 429/17 |
| 2008/0113306 | A1 | * | 5/2008 | Veasey et al. | 431/6 |
| 2009/0280448 | A1 | * | 11/2009 | Antxia Uribetxebarria et al. | 431/255 |
| 2010/0040915 | A1 | * | 2/2010 | Wakita et al. | 429/17 |
| 2010/0126070 | A1 | * | 5/2010 | Lee et al. | 48/62 R |
| 2010/0147291 | A1 | * | 6/2010 | Vandrak | 126/92 R |
| 2010/0282325 | A1 | * | 11/2010 | Cimino | 137/1 |
| 2011/0042472 | A1 | * | 2/2011 | Vandrak | 237/2 R |
| 2011/0126816 | A1 | * | 6/2011 | Salbide Mutiloa et al. | 126/42 |
| 2013/0008423 | A1 | * | 1/2013 | Noble et al. | 126/116 |

OTHER PUBLICATIONS

Dynamx Incorporated Warehouse Appliance (web page), Williams Heaters—Vent-Free Honts,,.. Models, data sheets pp. 1-4, Jun. 26, 2002.

AGA, American Gas Association, Fact Sheet, "Oxygen Depletion Sensing (ODS) Systems":/ Dec. 1984.

Bullfinch (Gas Equipment) Limited, The Simba Range Ultra Safe-Low Cost Mobile Cabinet Heaters, 2 pages, undated.

Brians of Sheerness, Valor Fires, data sheets pp. 1-2, Mar. 6, 2002.

Mobil Mobile Gas Supplies, Thurcroft Stove, data sheets pp. 1-2, Mar. 6, 2002. e Gas Supplies, Thurcroft Stove, data sheets pp. 1-2.

The Coleman Co., Inc., 3000 BTU Propane Catalytic Heater, instructions for use pp. 1-4, undated.

Mobile Gas Supplies, Mobile Heaters, data sheets pp. 1-4, Mar. 6, 2002.

Notification of Transmittal of The International Search Report and the Written Opinion of the International Searching Authority dated Jun. 14, 2005.

* cited by examiner

PORTABLE CATALYTIC HEATER

TECHNICAL FIELD

Provided is a portable catalytic heater. More particularly, provided is portable catalytic heater comprising a device to shut down the portable catalytic heater in response to certain atmospheric conditions.

BACKGROUND

Without limitation, combustion-powered heaters may comprise catalytic heaters and heaters with burners. Combustion-powered heaters combust reactants to yield heat and reaction products. Combustion-powered heaters consume a fuel and an oxidant and react the fuel and oxidant to yield heat and one or more combustion products. Some combustion-powered heaters modify the composition of the atmosphere by uptake of one or more reactants from the atmosphere, or release of one or more combustion products into the atmosphere, or both.

In some combustion-powered heaters, a combustion process consumes oxygen from the atmosphere as a combustion reactant. The consumption of oxygen by a combustion-powered heater can modify the composition of the atmosphere by reducing the oxygen therein. In some amounts, reduced oxygen may be undesirable. It remains desirable to develop technology to detect and address atmospheric conditions such as undesirable amounts of oxygen.

Without limitation, some combustion-powered heaters release a combustion product into the atmosphere. A combustion product may comprise, but is not limited to, carbon dioxide, carbon monoxide, nitrogen oxides. The release of a combustion product can modify the composition of the atmosphere by increasing the amount of a combustion product therein. Without limitation, increasing the amount of a combustion product in the atmosphere can decrease the percentage of other atmospheric constituents therein. Without limitation, in some amounts, the presence of a combustion product may be undesirable. It remains desirable to develop technology to detect and address atmospheric conditions such as an undesirable amount of a combustion product in the atmosphere.

SUMMARY

Provided is a portable heating device comprising a combustion-powered heater, a regulator, and an oxygen depletion sensor. The combustion-powered heater may be supplied by an associated fuel source and may comprise a combustion region comprising a catalytic surface. The regulator may be adapted for fluid communication with the associated fuel source. The oxygen depletion sensor may comprise a burner and a temperature detector. The burner may be in fluid communication with the regulator and may be adapted to combust fuel form the regulator with air to produce a flame. The temperature detector may be adapted to detect the temperature of the flame and may be adapted to selectively render the combustion-powered heater non-functional.

Further provided is a portable combustion-powered heater supplied by an associated fuel source. The combustion-powered heater may comprise a combustion region comprising a catalytic surface, a regulator operationally engaged with the associated fuel source, a valve, and an oxygen depletion sensor operationally engaged with the regulator. The oxygen depletion sensor may comprise, a burner in operative engagement with said regulator and a detector. The burner may be adapted to combust fuel in air to produce a flame. The detector may be adapted to detect a first property of the flame.

Further provided is a portable heating device comprising a combustion-powered heater, a regulator, a normally-closed valve, and an oxygen depletion sensor. The combustion-powered heater may be supplied by an associated fuel source. The fuel source may comprise propane. The combustion-powered heater may comprise a combustion region. The combustion region may comprise a catalyst and a substrate. The catalyst may comprise ruthenium, rhodium, palladium, osmium, iridium, platinum, or mixtures thereof. The substrate may comprise a glass fiber, a porous metal, a ceramic, or a mixture thereof. The combustion-powered heater may be adapted to consume oxygen from the atmosphere as a combustion reactant or adapted to release a combustion product into the atmosphere, or both. The regulator may be operationally engaged with the associated fuel source. The regulator may be adapted to accept a flow of fuel from the associated fuel source and output a flow of fuel. The outputted flow of fuel may be limited to a pressure of approximately eleven inches of water column. The normally-closed valve may be in fluid communication with the combustion region and in fluid communication with the associated fuel source. The normally-closed valve may be adapted to shut-off said combustion-powered heater when closed. The oxygen depletion sensor may comprise a burner and a detector. The burner may be in operative engagement with said regulator. The burner may be adapted to combust fuel in air to produce a flame. The detector may be adapted to detect a first property of the flame. The detector may be adapted to hold open said normally-closed valve unless the detected first property of the flame do not meet predetermined criteria. The flame may be adapted to have the first property not meet the predetermined criteria when the air comprises a carbon dioxide amount in the air of more than 5000 PPM, or the air comprises a carbon monoxide amount in the air of more than 100 PPM, or the air comprises at least 82% by volume non-oxygen components, or any combination thereof.

BRIEF DESCRIPTION OF THE DRAWINGS

The present subject matter may take physical form in certain parts and arrangement of parts, embodiments of which are described in detail in this specification and are illustrated in the accompanying drawings.

DETAILED DESCRIPTION

Figure 1:
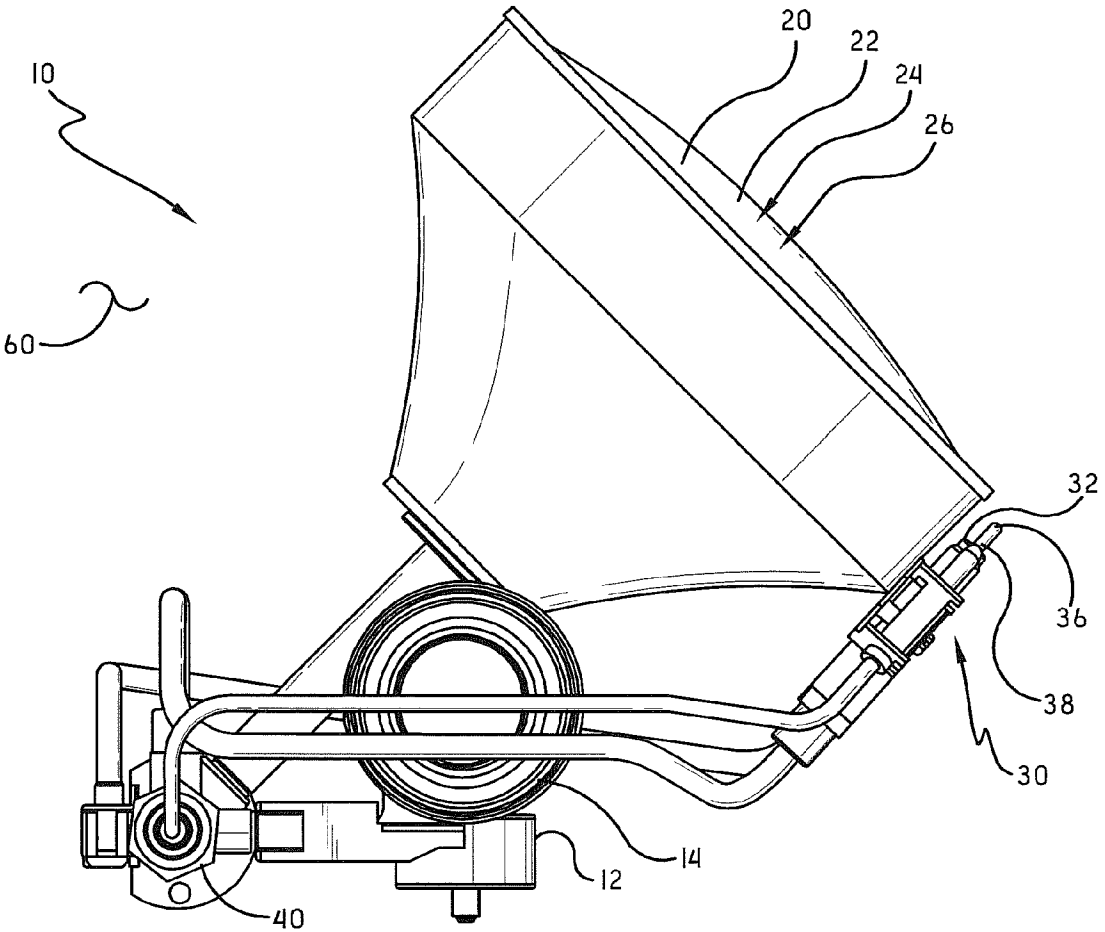
FIG. 1 is a view of one embodiment of a portable catalytic heater assembly.

Reference will be made to the drawings, FIGS. 1-2, wherein the showings are only for purposes of illustrating certain embodiments of a portable catalytic heater, and not for purposes of limiting the same. Specific characteristics relating to the embodiments disclosed herein are not to be considered as limiting, unless the claims expressly state otherwise.

Portable heaters 10 may be combustion-powered. A combustion-powered portable heaters 10 may combust a fuel and an oxidant in a combustion region 20. A combustion region 20 may comprise, without limitation, a catalytic surface 22 or a burner (not shown).

A catalytic surface 22 is a combustion region 20 adapted so that a fuel and an oxidant may react thereupon in catalyzed reaction to yield heat and a combustion product. Without limitation, some portable heaters 10 release combustion products to the atmosphere 60.

The material of the catalytic surface 22 may act as a catalyst 24 in a combustion reaction in the combustion region 20. Without limitation, a catalyst 24 in a combustion reaction may change the combustion reaction by speeding up the reaction, slowing down the reaction, lowering the ignition energy needed to initiate the combustion reaction, promoting more complete combustion, promoting cleaner combustion, reducing or eliminating certain combustion products, or increasing operating efficiency.

Without limitation, some fuels that a portable heater may react comprise, methane, ethane, propane, butane, pentane, LP gas, other gas mixtures, and kerosene. Without limitation, some oxidants that a portable heater may react comprise oxygen, gas mixtures comprising oxygen, nitrous oxide, or mixtures thereof. Without limitation, air is a gas mixture comprising oxygen that may be used to provide an oxidant for use as a combustion reactant.

Use of air, use oxygen from the air, or release of combustion products to the atmosphere 60 can affect air quality. Without limitation, some portable heaters consume oxygen from the atmosphere 60 as a combustion reactant.

Without limitation, some catalytic surfaces 22 comprise a catalyst 24 supported by a substrate 26. In certain embodiments a catalyst 24 may comprise ruthenium, rhodium, palladium, osmium, iridium, platinum, and mixtures thereof. A substrate 26 may comprise a glass fiber, a porous metal, a ceramic, or a mixture thereof.

Without limitation, a portable heater 10 may comprise a detector for gauging air quality directly or indirectly. In certain embodiments, a detector for gauging air quality may comprise an oxygen depletion sensor 30. In certain embodiments a detector for gauging air quality may detect temperature.

In certain embodiments, and without limitation, an oxygen depletion sensor 30 comprises a burner 32 adapted to produce a flame and a temperature detector 36. In certain embodiment and without limitations, the temperature detector 36 may comprise a thermocouple, a thermoelectric material, a pyrometer, a bimetallic strip, or a thermostat. An oxygen depletion sensor 30 may be adapted to detect certain levels of a gas. In some embodiments, the oxygen depletion sensor 30 may be adapted to detect undesirable levels of a gas.

In certain embodiments, of an oxygen depletion sensor 30, the detector 36 is adapted to detect the characteristics of temperature of a flame (not shown) produced by the burner 32. The detector 36 is adapted to hold open a normally-closed valve unless the temperature of the flame does not meet a predetermined criteria. In certain embodiments, the detector 36 produces a current sufficient to hold open a normally-closed valve 40 as a result of the detection of a flame temperature meeting the predetermined criteria. In some embodiments a produced current sufficient to hold open a normally-closed valve 40 may hold open the normally-closed valve 40 electromagnetically.

In certain embodiments, a flame produced by the burner 32 is adapted to have a temperature that does not meet the predetermined criteria if the air quality is bad. The quality that makes air bad is subject to engineering judgment. In certain embodiments, and without limitation, the air is bad if the air comprises a carbon dioxide amount in the air of more than 5000 PPM, or the air comprises a carbon monoxide amount in the air of more than 100 PPM, or the air comprises at least 82% by volume non-oxygen components, or any combination thereof.

Non-oxygen components refers to those components in the air, including, but not limited to, nitrogen, argon, and carbon dioxide, that are not oxygen. If oxygen is removed from the atmosphere 60, the percentage by volume of non-oxygen components may increase. If non-oxygen components, such as, without limitation, carbon monoxide, carbon dioxide, or nitrogen oxides, are introduced to the atmosphere 60, the percentage by volume of non-oxygen components may increase.

Without limitation, an oxygen depletion sensor 30 may detect undesirable levels of oxygen, carbon monoxide, or carbon dioxide. An atmosphere 60 devoid of undesirable levels of a gas may be described as good air or as having good air quality. An atmosphere 60 comprising undesirable levels of a gas may be described as bad air or as having bad air quality.

In certain embodiments, and without limitation, an oxygen depletion sensor 30 may accept air from the atmosphere 60 for use as a reactant in the combustion of fuel in the burner 32. The composition of the atmosphere 60 can substantially affect performance of the flame produced by the burner 32 during operation. During operations in good air, the flame produced by the burner 32 of an oxygen depletion sensor 30 may be of a first predictable temperature. During operation in bad air, the flame produced by the burner 32 of an oxygen depletion sensor 30 may be of a second predictable temperature. For example, and without limitation, in some embodiments, a flame produced in bad air may be lower in temperature, cooler than, a flame produced in good air.

Because of predictable flame temperature differences between a flame produced from combustion in good air and a flame produced from combustion in bad air, a temperature detector 36 may be used to detect temperature changes related to changes of air quality and, thereby, used as a predictor of atmospheric conditions in terms of good air versus bad air. That is, a temperature detector 36 may be used to discriminate between operations within good air and operations within bad air by measuring a flame temperature affected by air quality.

In certain embodiments, and without limitation, an oxygen depletion sensor 30 comprises a burner 32 and a thermocouple 38. In certain embodiments, the temperature of the flame produced by the burner 32 in bad air is cooler than a flame produced in good air. In certain embodiments, the thermocouple 38 may be so arranged as to detect the temperature difference in the flame and to produce an output signal representative of the air quality. In certain embodiments, the thermocouple 38 may be arranged to be proximate to the flame or immersed in the flame or in any arrangement consistent with good engineering practice that will discriminate the flame temperature differences of interest. In certain embodiments, a flame produced by combustion in good air quality will produce a output signal from the thermocouple 38 consistent with good air quality, and will produce sufficient current to hold open a normally-closed valve. In certain embodiments, a flame produced by combustion in bad air quality will not produce an output signal from the thermocouple 38 consistent with good air quality, and will not produce sufficient current to hold open a normally-closed valve. In certain embodiments, a flame produced by combustion in bad air quality will not produce any substantial output signal from the thermocouple 38.

In certain embodiments, failure of the detector 36 to produce an output signal consistent with good air may trigger actions to cease heater 10 operations. In certain embodiments, actions to cease heater 10 operations include shut off or shut down of the heater 10. In certain embodiments, actions to cease heater 10 operations include shut off, closing, or shut down of the heater 10 comprise closing of a valve 40 to interrupt fuel flow necessary to continuing operation of the heater 10. In certain embodiments, and without limitation, the detector 36 is operationally engaged with and holds open a normally-closed valve 40 unless the detector fails to detect a temperature consistent with operation of the burner 32 in good air. In some embodiments, closing of said valve 40 terminates a flow of fuel necessary to the continued operation of heater 10 and, thereby, stops heater 10 operation.

Figure 2:
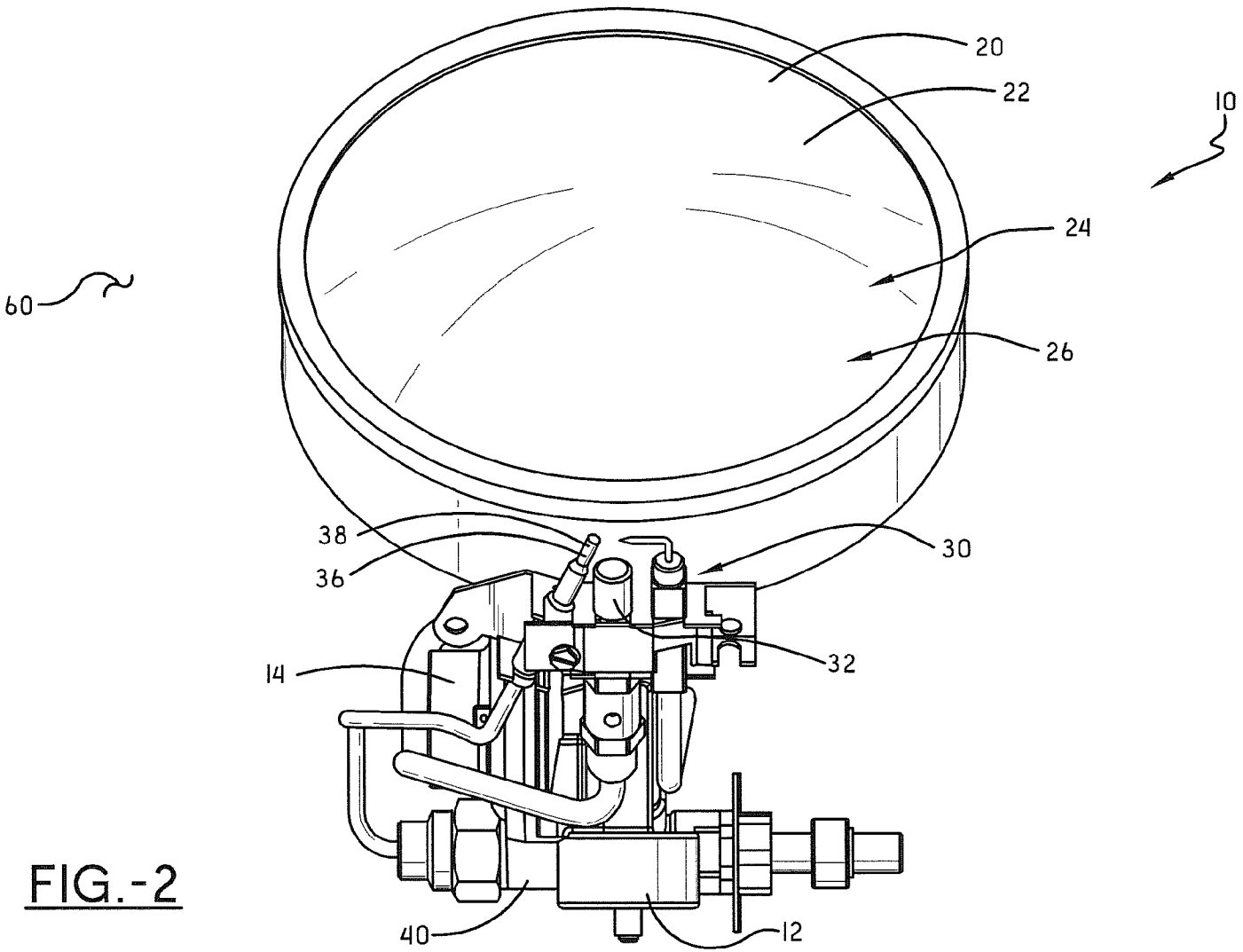
FIG. 2 is another view of one embodiment of a portable catalytic heater assembly.

In the non-limiting embodiment shown in FIGS. 1 and 2 a portable catalytic heater 10 is adapted to be supplied by an associated fuel source (not shown). Heater 10 may comprise a fuel source connection 12. Without limitation, a fuel source connection 12 may comprise a female-threaded region (not shown) adapted for connection to an associated male-threaded fuel source (not shown). Without limitation, a fuel source connection 12 may be adapted for connection to an associated propane fuel tank or bottle.

A portable catalytic heater 10 may comprise a combustion region 20 comprising a catalytic surface 22. When the portable catalytic heater 10 is in operation, the combustion region 20 may receive fuel from an associated fuel source (not shown) through a valve 40. In operation, the combustion region 20 may receive air (not shown) from the atmosphere 60 and may react the air and the fuel upon catalytic surface 26 to yield heat and a combustion product. A combustion product may be released to the atmosphere 60.

Heater 10 may, optionally, comprise a regulator 14. When the portable catalytic heater 10 is in operation, an optional regulator 14 may receive fuel from an associated fuel source 40. The regulator 14 may throughput fuel at a regulated pressure. In some embodiments, without limitation, a heater 10 may comprise a regulator 14 to regulate the pressure of fuel directed to an oxygen depletion sensor 30, a regulator 14 to regulate the pressure of fuel directed to a combustion region 20, or both. In certain embodiments, the fuel directed to an oxygen depletion sensor 30 or the fuel directed to a combustion region 20 are not regulated. Without limitation, in certain embodiments, the regulated pressure may be approximately eleven inches of water column.

In operation, burner 32 may burn the fuel with air from the atmosphere 60, may produce a flame (not shown), and may produce combustion products (not shown). A combustion product may be released to the atmosphere 60. The flame produced by burner 32 may interact with thermocouple 38 in a manner that depends upon the quality of the air. If the air is good, then flame may heat thermocouple 38 sufficiently to produce an output signal consistent with good air quality. If the air is bad, then the flame may not heat thermocouple 38 sufficiently to produce an output signal consistent with good air quality. If the thermocouple 38 is not heated sufficiently to produce an output signal consistent with good air quality, then valve 40 will close stopping fuel supply to combustion region 20 and thereby shutting down the portable catalytic heater 10.

While the portable catalytic heater has been described above in connection with the certain embodiments, it is to be understood that other embodiments may be used or modifications and additions may be made to the described embodiments for performing the same function of the portable catalytic heater without deviating therefrom. Further, the portable catalytic heater may include embodiments disclosed but not described in exacting detail. Further, all embodiments disclosed are not necessarily in the alternative, as various embodiments may be combined to provide the desired characteristics. Variations can be made by one having ordinary skill in the art without departing from the spirit and scope of the portable catalytic heater. Therefore, the portable catalytic heater should not be limited to any single embodiment, but rather construed in breadth and scope in accordance with the recitation of the attached claims.

What is claimed is:

1. A portable heating device comprising:

a combustion-powered heater, supplied by an associated fuel source, and comprising a combustion region comprising a catalytic surface;

a regulator adapted for fluid communication with the associated fuel source; and an oxygen depletion sensor (ODS), configured to selectively render the combustion-powered heater non-functional when a non-desired atmosphere is detected, said ODS comprising a burner in fluid communication with said regulator, said burner adapted to combust fuel from said regulator with air to produce an ODS flame, and a temperature detector, adapted to detect the temperature of said ODS flame wherein said temperature of said ODS flame is indicative of a desired atmosphere and said non-desired atmosphere; wherein said ODS flame is adapted to have a temperature indicative of the non-desired atmosphere when the atmosphere comprises one or more of: a carbon dioxide amount of more than 5000 PPM; a carbon monoxide amount of more than 100 PPM; or at least 82% by volume non-oxygen components.

2. The heating device of claim 1, wherein said combustion-powered heater is adapted to consume oxygen from the atmosphere as a combustion reactant or is adapted to release a combustion product into the atmosphere.

3. The heating device of claim 2, wherein said regulator is adapted to output a flow of fuel from the associated fuel source to the ODS burner a pressure of approximately eleven inches of water column.

4. The heating device of claim 1, wherein said catalytic surface comprises a catalyst and a substrate.

5. The heating device of claim 1, wherein said combustion-powered heater further comprises a valve in fluid communication with said combustion region and in fluid communication with said associated fuel source.

6. The heating device of claim 5, wherein said ODS is configured to close said valve upon detection of temperature of said ODS flame indicative of the non-desired atmosphere.

7. The heating device of claim 4, wherein said catalyst comprises ruthenium, rhodium, palladium, osmium, iridium, platinum, or mixtures thereof.

8. The heating device of claim 4, wherein said substrate comprises a glass fiber, a porous metal, a ceramic, or a mixture thereof.

9. The heating device of claim 1, wherein said associated fuel source comprises propane.

10. A portable combustion-powered heater supplied by an associated fuel source, said combustion-powered heater comprising:

a combustion region comprising a catalytic surface;

a regulator operationally engaged with the associated fuel source;

a valve; and an oxygen depletion sensor (ODS), operationally engaged with said regulator, and configured to detect a non-desired atmosphere, said ODS comprising, a burner in operative engagement with said regulator, said burner adapted to combust fuel in air to produce an ODS flame, and a detector, said detector being adapted to detect a first property of the ODS flame, wherein the first property of the ODS flame is an ODS flame temperature indicative of a a desired atmosphere and said non-desired atmosphere; wherein first property is indicative of said non-desired atmosphere when the atmosphere comprises one or more of: a carbon dioxide amount of more than 5000 PPM; a carbon monoxide amount of more than 100 PPM; or at least 82% by volume non-oxygen components.

11. The combustion-powered heater of claim 10, wherein said combustion-powered heater consumes oxygen from the atmosphere as a combustion reactant, or releases a combustion product into the atmosphere, or both.

12. The combustion-powered heater of claim 10, wherein said catalytic surface comprises a catalyst and a substrate and wherein:

said catalyst comprises ruthenium, rhodium, palladium, osmium, iridium, platinum, or mixtures thereof; and said substrate comprises a glass fiber, a porous metal, a ceramic, or a mixture thereof.

13. The combustion-powered heater of claim 10, wherein said valve is adapted to shut-off said combustion-powered heater when closed.

14. The combustion-powered heater of claim 10, wherein said valve is a normally-closed valve.

15. The combustion-powered heater of claim 14, wherein said ODS is adapted to hold open said normally-closed valve unless the non-desired atmosphere is detected.

16. The combustion-powered heater of claim 10, wherein said regulator is adapted to output a flow of fuel from the associated fuel source to the ODS burner a pressure of approximately eleven inches of water column.

17. The combustion-powered heater of claim 10, wherein said fuel is propane.

18. A portable heating device comprising:

a combustion-powered heater supplied by an associated fuel source, wherein said fuel source comprises propane, and wherein said combustion-powered heater comprises a combustion region comprising a catalytic surface comprising a catalyst and a substrate, and wherein:

said catalyst comprising ruthenium, rhodium, palladium, osmium, iridium, platinum, or mixtures thereof, and said substrate comprising a glass fiber, a porous metal, a ceramic, or a mixture thereof;

said combustion-powered heater is configured to perform one or more of:

consume oxygen from the atmosphere as a combustion reactant or release a combustion product into the atmosphere;

a regulator operationally engaged with the associated fuel source, wherein said regulator is configured to output a flow of fuel from the associated fuel source to an ODS burner a pressure of approximately eleven inches of water column.

a normally-closed valve, wherein said valve is in fluid communication with said combustion region and in fluid communication with said associated fuel source, and wherein said valve is configured to shut-off said combustion-powered heater when closed; and an oxygen depletion sensor (ODS), configured to hold open said normally-closed valve unless a depleted level of oxygen is detected, said ODS comprising, said ODS burner in operative engagement with said regulator, wherein said ODS burner is configured to combust fuel in air to produce an ODS flame a detector, wherein said detector is configured to detect a first property of the ODS flame and wherein the first property of the ODS flame is indicative of a depleted oxygen content when the atmosphere comprises a carbon dioxide amount of more than 5000 PPM, or the atmosphere comprises a carbon monoxide amount of more than 100 PPM, or the atmosphere comprises at least 82% by volume non-oxygen components, or any combination thereof.

19. The heating device of claim 18 wherein, said first property of the ODS flame is temperature; and said depleted level of oxygen is indicated by a temperature operating outside of an acceptable temperature operating range.

* * * * *

UNITED STATES PATENT AND TRADEMARK OFFICE

CERTIFICATE OF CORRECTION

PATENT NO. : 8,684,276 B2
APPLICATION NO. : 12/544466
DATED : April 1, 2014
INVENTOR(S) : Brian S. Vandrak It is certified that error appears in the above-identified patent and that said Letters Patent is hereby corrected as shown below:

In the Specification

In the Detailed Description, Column 5, line 25 – reads "surface 26" – and should read, -- "surface 22."

In the Detailed Description, Column 5, lines 30 and 31 – reads "fuel source 40" – and should read, – "fuel source."

Signed and Sealed this
Second Day of September, 2014

Michelle K. Lee

Michelle K. Lee
*Deputy Director of the United States Patent and Trademark Office*